United States Patent [19]

Kramer

[11] Patent Number: 4,914,275

[45] Date of Patent: Apr. 3, 1990

[54] REGASIFIER

[75] Inventor: Robert A. Kramer, Crown Point, Ind.

[73] Assignee: Northern Indiana Public Service Company, Hammond, Ind.

[21] Appl. No.: 268,800

[22] Filed: Nov. 8, 1988

[51] Int. Cl.[4] ..... F22B 1/28

[52] U.S. Cl. ..... 219/275; 219/272; 219/319

[58] Field of Search ..... 219/271–276, 219/282, 316, 319, 320, 322, 321, 333, 362; 62/50.2; 137/341

[56] References Cited

U.S. PATENT DOCUMENTS

| | | | |
|---|---|---|---|
| 2,004,976 | 6/1935 | Carleton | 219/319 |
| 2,623,153 | 12/1952 | McGinnis | 219/333 |
| 2,727,979 | 12/1955 | Altosaar | 219/319 |
| 3,381,111 | 4/1968 | Popyk | 219/282 |
| 4,645,904 | 2/1987 | Moraski | 219/275 |

FOREIGN PATENT DOCUMENTS

| | | | |
|---|---|---|---|
| 417510 | 7/1924 | Fed. Rep. of Germany | 219/320 |
| 1078589 | 11/1954 | France | 219/320 |
| 58-19901 | 2/1983 | Japan | 219/333 |

*Primary Examiner*—Teresa J. Walberg
*Attorney, Agent, or Firm*—Richard Bushnell

[57] ABSTRACT

An apparatus for regasifying liquified products such as natural gas includes an outer pressure vessel, an inner vessel for receiving liquified gas and a plurality of individually controllable heating assemblies stacked within the inner vessel. Each of the heating assemblies includes a plurality of sets of heating coils constructed for promoting the flow of liquified gas therethrough in a manner for enhancing the efficiency of the heating and regasifying operation.

16 Claims, 3 Drawing Sheets

REGASIFIER

The present invention relates to a novel apparatus for converting a liquid material to its gaseous state, and more specifically, to a novel apparatus for regasifying liquified natural gas or any other liquified gas.

There are many instances in which it has been found desirable to liquify gaseous materials such as natural gas for facilitating storage and transportation of the product. For example, it is known that the volumetric ratio of natural gas to liquified natural gas is about 630 to 1 and it is thus apparent that significant savings can be achieved by handling and storing the product in the liquid state as a result of the great reduction in volume. However, before the product is useful as an energy source, it must be reconverted from the liquid state to the gaseous state.

While various uses for regasifying apparatus of the type contemplated herein may become apparent, it is contemplated that one use will be for supplying gas to a distribution system capable of filling tanks in vehicles which utilize natural gas as a power source. As is well known, companies such as utilities frequently store large quantities of liquified natural gas, and it is contemplated that such storage facilities may provide a convenient source of liquified natural gas to regasifying apparatus of the type contemplated herein.

SUMMARY OF THE INVENTION

It is an important object of the present invention to provide a novel apparatus which is capable of regasifying liquid natural gas and the like quickly and efficiently so as to provide gas to a vehicle filling or other distribution system economically and at desired volumes and rates of flow.

A more specific object of the present invention is to provide a novel regasifier apparatus of the above described type which is of relatively simple and highly efficient construction.

A further object of the present invention is to provide a novel regasifying apparatus of the above described type which may be easily and safely operated.

A still further object of the present invention is to provide a novel regasifying apparatus of the above described type which includes a high pressure vessel and an inner vessel for receiving liquified gas with an array of heating coils constructed, arranged and controlled within the inner vessel for heating and gasifying the liquified gas in a controlled manner avoiding undue turbulence for promoting more efficient conversion from liquid to gas.

Other objects and advantages of the present invention will become apparent from the following description and the accompanying drawings.

DETAILED DESCRIPTION OF AN ILLUSTRATIVE EMBODIMENT

Figure 1:
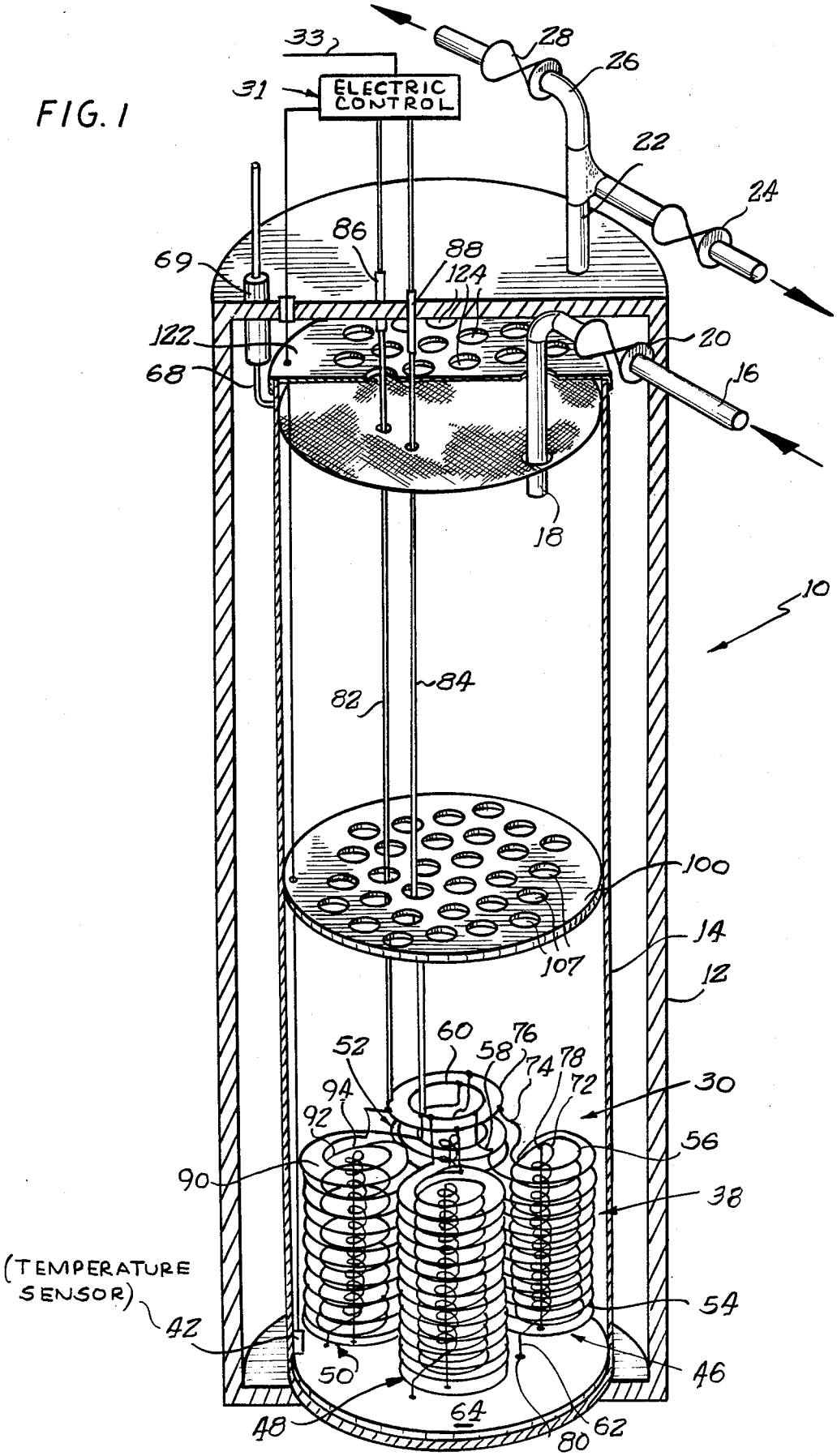
FIG. 1 is a simplified perspective view, partially broken away for illustration purposes, showing a regasifying apparatus incorporating features of the present invention.
Figures 2, 3:
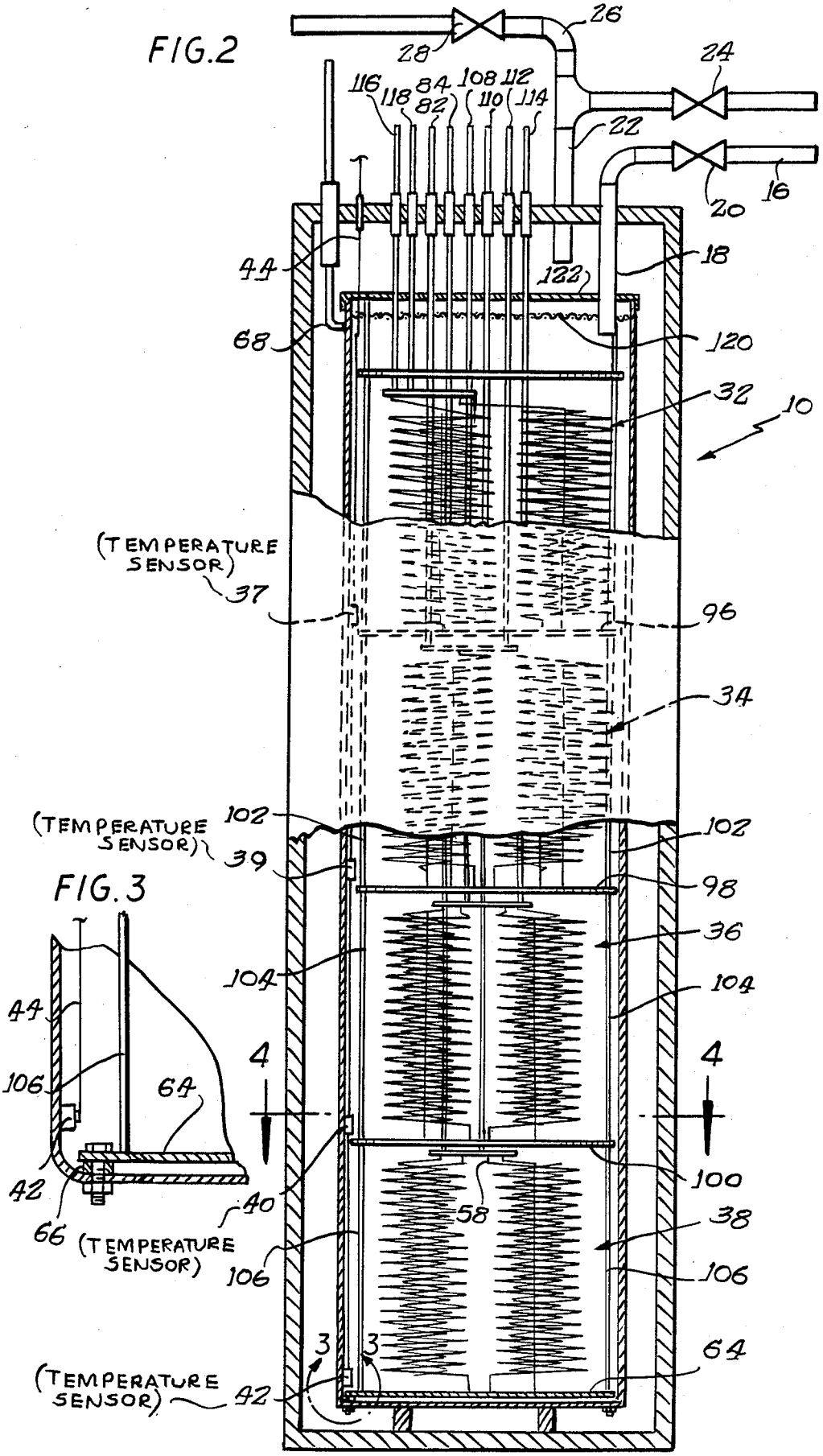
FIG. 2 is a side elevational view, partially broken away showing the regasifying apparatus of FIG. 1.
FIG. 3 is an enlarged fragmentary sectional view showing a portion of the apparatus included in the circle in FIG. 2.
Figure 4:
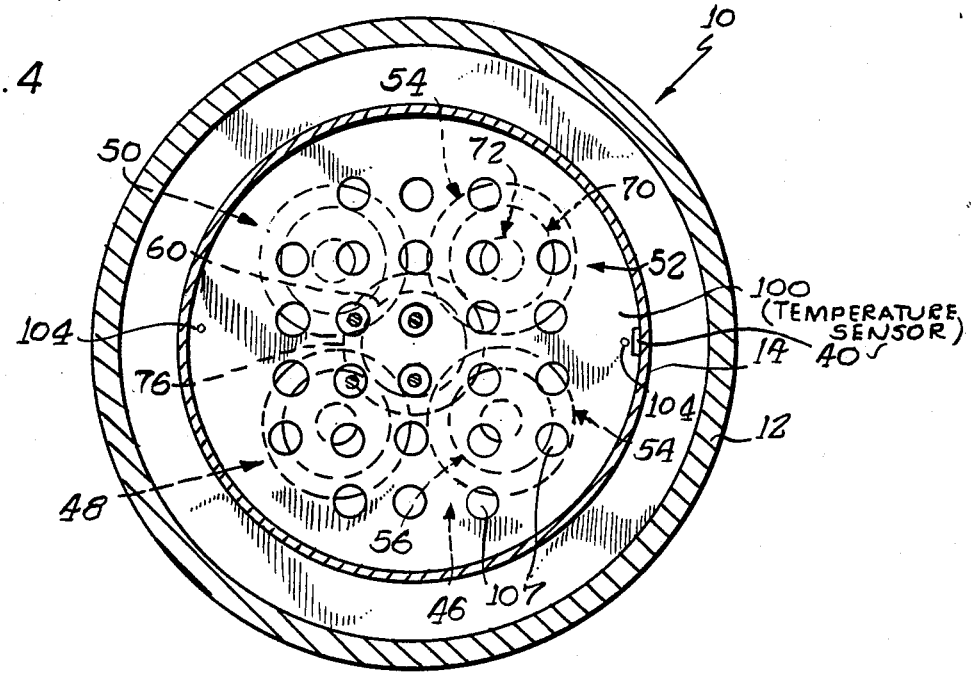
FIG. 4 is an enlarged sectional view taken along line 4—4 in FIG. 2.
Figure 5:
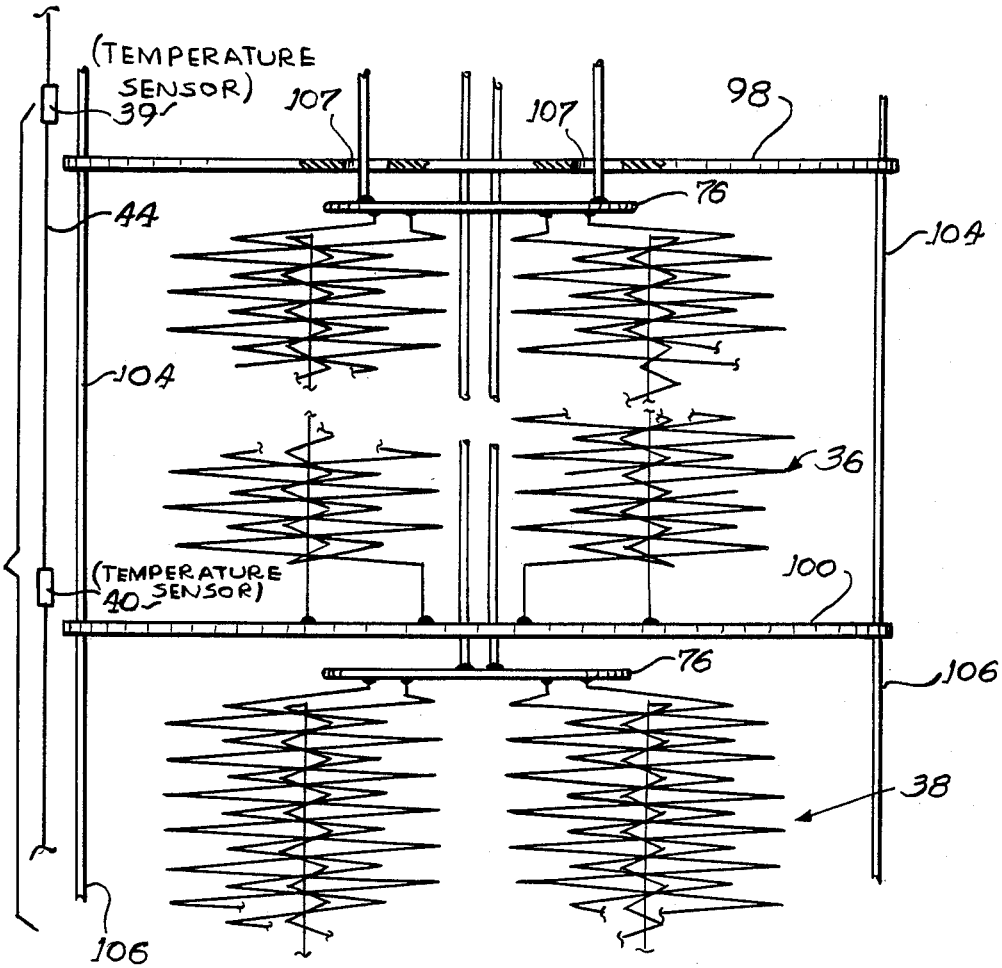
FIG. 5 is an enlarged fragmentary side elevational view, partially broken away, showing a portion of heating elements constructed in accordance with the features of the present invention and included in the regasifying apparatus.

Referring now more specifically to the drawings wherein like parts are designated by the same numerals throughout the various figures, a regasifying apparatus 10 incorporating features of the present invention is shown in FIGS. 1, 2 and 4. It is to be noted that, in FIG. 1, portions of the apparatus have been omitted and simplified so as to facilitate the disclosure.

In general, the regasifying apparatus includes an outside high pressure vessel or tank 12 preferably constructed of carbon steel and capable of containing the gas pressures necessary to handle gas such as natural gas in a liquified state. An inner vessel 14 is supported within and electrically insulated from the outer vessel 12. The inner vessel preferably is formed from relatively thin aluminum sheet. The inner vessel is adapted to receive and contain liquified natural gas from a suitable source of supply, not shown, connected to the regasifying apparatus by supply pipes 16 and 18 and control valve 20. Regasified gas is directed from the vessel 12 to a suitable distribution system such as a vehicle tank filling system, not shown, through discharge pipe 22 and a metering and control valve 24 of known construction. Alternatively, gas may be directed from a discharge pipe 22 to another distribution system or storage facility simply bled off through pipe 26 and a metering and control valve 28 of known construction.

In accordance with a feature of the present invention, the apparatus 10 is provided with heating means 30 within the inner vessel 14 for heating and gasifying liquified gas. The heating means comprises a plurality of sets of assemblies 32, 34, 36 and 38 of heating members or coils described more in detail below. As will be apparent, the heating coil assemblies 32–38 are vertically stacked with respect to each other and will be immersed in the liquified gas when the inner vessel 14 is substantially full of liquid. As the liquid is regasified, the level of the liquid will gradually drop progressively below the levels of the coil assemblies 32, 34, 36 and 38. Preferably, the coil assemblies are individually controlled so that they may be individually turned off when the level of the liquid falls below a certain point. For example, if the level of the liquid falls below the coil assembly 32, the control means is such that the coils of this assembly are turned off while the coils of the remaining assemblies remain energized. Of course, it is contemplated that the coils of the assembly 34 will be deenergized when the level of the liquid falls to a point such that they are no longer substantially immersed and the coils of the assemblies 36 and 38 will similarly be successively deenergized as the level of the liquid falls.

The control means for the electric coils may comprise various known components. FIG. 1 shows, in schematic form, control means 31 connected between power line 33 and the heating coils. The control means comprises a plurality of switches of known construction, which switches include sensors of known construction responsive to variations in current flow through the heating coils. As is known, when the heating coils are immersed in cold liquified natural gas, their resistance is relatively low and current can flow relatively freely therethrough. When the liquid level falls below the heating coil, its temperature increases which results in an increase in its resistance and a decrease in the current flow. When the sensors in the control means detect a sufficient decrease in the current flow to indicate that the liquid level has fallen below or at least to a predetermined point with respect to a particular heating coil, an associated switch in the control means will operate to deenergize that coil.

The control means may include either alternatively to or in addition to the current sensors for actuating the switches, temperature sensors 37, 39, 40 and 42 connected by a cable 44 to the switching circuitry of the control means 31. As shown in FIG. 2, the temperature sensors are located toward the bottom of the respective heating coil assemblies 32, 34, 36 and 38 so as to provide a signal responsive to an increase in temperature when the level of the cold liquified gas falls below the respective temperature sensors.

In accordance with a feature of the present invention, the heating coil assemblies 32–38 are constructed and arranged so as to promote rapid and efficient heat transfer between the coils and the liquified gas without causing undue boiling or turbulence in the liquid. More specifically, the construction is such as to cause the liquid gas to flow past the coils at a sufficient velocity to minimize film boiling or, in other words, to prevent a condition in which the surface of the coils becomes largely coated with a sheath of vapor or gas which would decrease efficiency and cause boiling instability. In addition, the action is such as to reduce the size of gas bubbles being formed and for preventing or minimizing surges within the liquid which might decrease efficiency or cause some of the liquid to boil over or splash out of the top of the inner vessel 14.

As shown in the drawings, the heating coil assembly 38 which is typical of the other heating coil assemblies comprises a plurality of sets 46, 48, 50 and 52 of vertically arranged helical outer members or coils 54 and inner members or coils 56. All of the coils are preferably formed from nichrome or other suitable wire. Each outer coil has a single winding with an upper end lead 58 connected to an electrical distribution ring 60. A lead 62 at the bottom end of the coil 54 is electrically connected with a bottom plate 64. As shown best in FIG. 3, the bottom plate 64 is mechanically and electrically connected by a fastener 66 with the bottom of the aluminum vessel 14. The vessel 14 is in turn connected to a neutral or ground wire 68 which extends therefrom and out of the pressure vessel through a suitable fitting or seal 69 as shown in FIGS. 1 and 2.

The inner coil 56 of each of the coil sets 46–52 is double wound so that it includes an outer winding 70 and an inner winding 72. In the embodiment shown, the outer winding 70 has an upper end lead 74 connected with an electrical distributing ring 76. The lower end of the outer winding 70 merges with the lower end of the inner winding 72 which spirals upwardly until it merges with a vertical straight lead 78 which extends downwardly and is electrically connected at 80 with the bottom or ground plate 64.

The distribution rings 60 and 76 are separately electrically connected with the control means by insulated wires 82 and 84 which extend upwardly and out of the pressure vessel through suitable seals 86 and 88. In addition to the previously discussed functions of the control circuit, means may be included therein for independently controlling and energizing the power applied to the wires 82 and 84 and thus to the outer and inner coils of each of the coil sets 46–52.

With the structure described above, it is seen that each coil set defines a plurality of vertical concentric flow paths 90, 92 and 94. In other words, the diameter of the outer coil 54 is sufficiently larger than the winding 70 of the inner coil 56 to define the annular flow path 90 and the winding 70 is sufficiently larger in diameter than the winding 72 so that the annular flow path 92 defined therebetween and the inner winding 72 is of sufficient diameter so that the flow path 94 is, in effect, that of a straight pipe.

When the heating coils are energized, the liquid in contact therewith is heated and begins to rise. The action is such that the liquid tends to flow upwardly through the paths 90, 92 and 94 as if through pipes. As the heating continues, a flow rate is obtained which has sufficient velocity to clean gas bubbles or vapor from the surface of the heating coils whereby to promote direct contact of coils with the liquid. This action enhances the efficiency of the system, tends to produce small gas bubbles and helps to minimize instability and surging within the liquid.

As previously indicated, the construction of the coil sets of the coil assembly 38 is typical of the coil sets for the assemblies 32, 34 and 36 and therefore these additional assemblies need not be described in detail and corresponding reference numerals have been applied to corresponding elements. It is noted however, that between each of the coil assemblies, a combined diffuser or surge arresting and ground plate is located. More specifically, a plate 96 is located immediately beneath the coil assembly 32, the plate 98 is located between the assemblies 34 and 36 and a similar plate 100 is located between the assemblies 36 and 38. The plates 96, 98 and 100 are mechanically supported by and electrically connected to the bottom ground plate 64 by rods 102, 104 and 106. Thus, these plates provide a part of the means for connecting the coils with which they are associated to the ground or neutral wire 68. In addition, the plates 96, 98 and 100 are formed with a plurality of apertures 107 therethrough as illustrated by the plate 100 in FIGS. 1 and 4. These apertures provide passageways for upwardly flowing gas bubbles and at the same time provide means for attenuating and controlling any large bubbles or surges which may develop in the liquid.

The coil assemblies 32, 34 and 36 are electrically connected with the control means 31 in the same manner as the coil assembly 38 described above. Thus, electrical conduits 108 and 110 extend from the control means to the distributing rings 60 and 76 of the coil assembly 32, insulated wires 112 and 114 extend to the corresponding distributing rings of the coil assembly 34, and insulated wires 116 and 118 extend to the distributing rings 60 and 76 of the coil assembly 36.

In order further to control splashing when the inner vessel 14 is substantially full of liquid, a screen 120 is secured within the vessel adjacent the top thereof. In addition, a cover 122 is provided over the top of the vessel 14, which cover has a plurality of apertures 124 therein for permitting the escape of gas.

As previously indicated, the regasifying apparatus of the present invention may be used for processing various liquified gas products. As an example, it is contemplated that the system may be used for filling the fuel tanks of vehicles. Typically, a vehicle utilizing natural gas for fuel may include a tank capable of holding 700 cubic feet of gas at an initial pressure of about 3,000 psi. When it is desired to fill such a tank, sufficient liquified natural gas is introduced from the source of supply, not shown, through the inlet pipes 16 and 18 into the inner vessel 14. Typically the liquified natural gas is introduced under a maximum pressure of about 100 psi. The tank of the vehicle, not shown, is then connected with the outlet conduit 22 and the valve 24 is opened. Then the control means 31 is actuated for energizing the coil assemblies 32, 34, 36 and 38. The cold liquified gas is quickly and efficiently heated in a manner described above so that the gas bubbles rise through the liquid into the pressure vessel 12 and then out through the discharge conduit 22. The heating of the gas causes the pressure to rise to about 4000 psi to 5000 psi for enabling filling of the vehicle tank to the pressure mentioned above. The efficiency of the apparatus is such that the process of filling a vehicle tank can be accomplished in approximately five minutes. After the filling operation has been completed excess gas in the regasifier is bled off through valve 28 to reduce the pressure sufficiently to permit the vessel to be recharged with liquified gas so that the process may be repeated.

While a preferred embodiment of the invention has been shown and described herein, it is obvious that many structural details may be changed without departing from the spirit and scope of the appended claims.

The invention is claimed as follows:

1. A regasifying apparatus comprising vessel means for receiving a quantity of liquified gas, and heating means within said vessel means for heating and gasifying the liquified gas, said heating means including heating members positioned within said vessel means for immersion in liquified gas said heating members comprising a first outer vertically and helically wound heating wire arranged in a generally upright coil and having a first predetermined diameter, and a second vertically and helically wound heating wire providing a coil within said first mentioned coil and having a diameter less than said first mentioned diameter, said first and second coils defining an annular flow passageway therebetween for heating and upwardly directing liquified gas to flow through said passageways at a sufficient velocity for sweeping gas bubbles from the surface of said coils and promoting liquid contact therewith thereby minimizing unstable boiling of the liquified gas.

2. A regasifying apparatus, as defined in claim 1, wherein said heating means comprises a plurality of said heating members arranged in generally vertically stacked relationship for heating liquified gas at successive levels within said vessel means.

3. A regasifying apparatus, as defined in claim 2, which includes means for selectively energizing and denergizing said heating members at different levels within the vessel means for energizing only heating members which are at least partially immersed in liquified gas.

4. A regasifying apparatus, as defined in claim 1, which includes a third coil within and having a diameter substantially less than said second coil, said second and third coils defining an annular flow passageway therebetween, and said third coil also defining a central flow passageway therethrough.

5. A regasifying apparatus, as defined in claim 4, wherein said second and third coils are connected in series.

6. A regasifying apparatus comprising a pressure vessel, an inner vessel mounted within said pressure vessel for receiving a quantity of liquified gas, a plurality of heating assemblies mounted in vertically stacked relationship within said inner vessel for heating and gasifying liquified gas, each of said heating assemblies including a first outer vertically and helically wound heating wire arranged in a generally upright coil and having a first predetermined diameter, and a second vertically and helically wound heating wire providing a coil within said first mentioned coil and having a diameter less than said first mentioned diameter, said first and second coils defining an annular flow passageway therebetween.

7. A regasifying apparatus, as defined in claim 6, which includes diffusion means between adjacent heating assemblies for reducing any turbulence in the liquified gas and permitting gas bubbles to pass upwardly out of said inner vessel.

8. A regasifying apparatus, as defined in claim 7, wherein said diffusion means comprises a plate having apertures therethrough.

9. A regasifying apparatus, as defined in claim 7, which includes perforated means at an upper end of said inner vessel for preventing splashing of liquified gas out of said inner vessel into the pressure vessel.

10. A regasifying apparatus, as defined in claim 6, which includes control means connected with said heating assemblies for selectively and individually energizing and deenergizing the heating coils of said assemblies.

11. A regasifying apparatus, as defined in claim 6, wherein said second coil of each of said sets comprises a first outer winding and a second inner winding, said outer winding combining with an adjacent first coil for defining an annular flow path and also combining with said second winding for defining a second annular flow path, and said second winding further defining a third central flow path.

12. A regasifying apparatus comprising a pressure vessel, an inner vessel mounted within said pressure vessel for receiving a quantity of liquified gas, said inner vessel including perforated means comprising a screen traversing the upper end portion of the inner vessel for preventing splashing of liquified gas out of said inner vessel into the pressure vessel, said screen having an apertured cover thereover, and wherein said regasifying apparatus further comprises a plurality of heating assemblies mounted in vertically stacked relationship within said inner vessel for heating and gasifying liquified gas, each of said heating assemblies includes diffusion means between adjacent heating assemblies for reducing any turbulence in the liquified gas and permitting gas bubbles to pass upwardly out of said inner vessel, said heating assemblies further including a plurality of annularly spaced upstanding sets of heating coils, each of said sets including a first coil and a second coil within said first coil, said coils of each set defining upstanding flow paths for heated liquified gas.

13. A regasifying apparatus comprising a pressure vessel, an inner vessel mounted within said pressure vessel for receiving a quantity of liquified gas, a plurality of heating assemblies mounted in vertically stacked relationship within said inner vessel for heating and gasifying liquified gas, each of said heating assemblies including a plurality of annularly spaced upstanding sets of heating coils, and each of said sets including a first coil and a second coil within said first coil, wherein said second coil of each of said sets comprises a first outer winding and a second inner winding, said outer winding combining with an adjacent first coil for defining an annular flow path and also combining with said second winding for defining a second annular flow path, and said second winding further defining a third central flow path, and wherein said regasifying apparatus further comprises first power lines respectively connected with the first coils of the sets of the respective heating assemblies, second power lines respectively connected with the second coils of the respective heating assemblies, and means providing a common neutral line connection to all of said coils.

14. A regasifying apparatus, as defined in claim 13, wherein said common neutral line means comprises diffusion plates between adjacent heating assemblies for reducing any turbulence in the liquified gas, said diffuser plates being electrically connected with said coils and with the neutral line.

15. A regasifying apparatus comprising a pressure vessel, an inner vessel mounted within said pressure vessel for receiving a quantity of liquified gas, said inner vessel being spaced from said pressure vessel by an open surrounding clearance space, said inner vessel having a liquified gas supply conduit communicating thereinto and passing through said surrounding clearance space such that said liquified gas supply is isolated from said clearance space and from contact with said pressure vessel and a heating assembly within said inner vessel for heating and gasifying said liquified gas.

16. A regasifying apparatus, as defined in claim 15, further comprising a discharge conduit communicating with said inner vessel for discharge of regasified gas therefrom, said discharge conduit further communicating with said open clearance space enabling entry of said regasified gas therein such that regasified gas pressure is equalized on said inner vessel within said pressure vessel.

* * * * *